United States Patent [19]

Backstein

[11] 4,026,214

[45] May 31, 1977

[54] IMPACT FUZE FOR ARTILLERY SHELL

[75] Inventor: Günter Backstein, Meerbusch, Germany

[73] Assignee: Rheinmetall G.m.b.H., Dusseldorf, Germany

[22] Filed: Dec. 5, 1975

[21] Appl. No.: 638,077

[30] Foreign Application Priority Data

Dec. 7, 1974 Germany ..... 2457946

[52] U.S. Cl. ..... 102/70.2 GA; 102/70.2 R

[51] Int. Cl.[2] ..... F42C 11/02

[58] Field of Search ..... 310/9.8; 102/70.2 GI, 102/70.2 GA

[56] References Cited

UNITED STATES PATENTS

| | | | |
|---|---|---|---|
| 2,849,957 | 9/1958 | Kuller et al. | 102/70.2 GA |
| 3,324,317 | 6/1967 | Hazelet | 102/70.2 GA |
| 3,349,709 | 10/1967 | Vilbajo | 102/70.2 GA |
| 3,842,742 | 10/1974 | Harnau | 102/70.2 GA |

*Primary Examiner*—Samuel W. Engle
*Assistant Examiner*—Thomas H. Webb
*Attorney, Agent, or Firm*—Ernest G. Montague; Karl F. Ross; Herbert Dubno

[57] ABSTRACT

An artillery shell is provided in its nose in front of its bursting charge and its detonator with an impact fuze consisting of a pressure-distributing plate engageable with the inside face of the nose, a piezoelectric crystal resting against the back face of this plate, and an anvil resting against the back of the crystal. A pin is seated in the anvil and extends transverse to the direction of travel of the projectile and a spring-steel wire has a front end looped around this pin and a rear end passing back through the bursting charge and connected to the shell detonator. When the crystal is compressed either by deformation of the nose of the shell or inertial pressure of the anvil against the back of the crystal, it generates electrical energy that is passed back through the spring-steel wire to the detonator to activate same.

6 Claims, 4 Drawing Figures

IMPACT FUZE FOR ARTILLERY SHELL

CROSS-REFERENCE TO RELATED APPLICATION

This application is related to copending, commonly owned and concurrently filed patent application 638,076.

FIELD OF THE INVENTION

This invention relates to a detonator for an artillery projectile. More particularly this invention concerns an impact fuze for firing the electrical detonator of such a shell.

BACKGROUND OF THE INVENTION

An artillery projectile or shell is known whose bursting charge is fired by a detonator that is itself activated by an electric charge. This detonator lies at the rear of the shell within the bursting charge. An impact fuze at the nose of the shell is connected to this detonator and serves to electrically activate it whenever the nose of the shell impacts something with a force exceeding a predetermined minimum.

The impact fuze usually has a piezoelectric crystal which is squeezed or crushed when the shell impacts an object and generates an electrical current. A usually copper wire screwed or soldered to this crystal or to an element carrying this crystal is insulated and extends back through the bursting charge to the detonator to carry the electrical current back to this detonator.

When such a projectile is fired with standard muzzle velocity the fuze can be counted on to operate perfectly so long as a relatively hard object is struck by the projectile. When, however, a high muzzle velocity is employed the wire frequently becomes disconnected, so that the fuze cannot operate and the projectile will not explode. Furthermore when a relatively soft object is struck the wire often works loose from the fuze and again renders the projectile nonexplosive.

OBJECTS OF THE INVENTION

It is therefore an object of the present invention to provide an improved artillery projectile.

Another object is the provision of an improved impact fuze for such a projectile.

Yet another object is the provision of an impact fuze which will detonate the bursting charge even when the projectile is used at a very high muzzle velocity or strikes a relatively soft object.

SUMMARY OF THE INVENTION

These objects are attained according to the present invention in an impact fuze having an anvil displaceable in the direction of travel in the projectile, means resting on the anvil for producing an electrical current when pressed against the anvil, a pin seated in the anvil and extending transversely to the direction, and a spring-steel wire having a front end looped around the pin and the rear end connected to the projectile detonator. This spring-steel wire carries current from the anvil to the detonator and is able to withstand the extreme acceleration and deceleration of the artillery projectile so as to maintain a good electrical connection between these elements.

In accordance with a further feature of this invention the means is a piezoelectric crystal sandwiched between a pressure distributing plate in front and the anvil in the rear, the entire assembly of plate, crystal, and anvil being slidable in the direction of displacement of the projectile toward its nose. Thus, when the projectile strikes a relatively soft object the entire arrangement can slide forwardly, compressing the crystal and producing the necessary energy to fire the charge's detonator.

According to yet another feature of this invention, there is provided in front of the pressure-distributing plate an elastomeric element, either a compression spring or a block of elastomeric material such as foam rubber. In addition the crystal, anvil, and pressure-distributing plate are all slidable within an insulating sleeve so that only when the nose of the projectile is crushed or the assembly slides forward inside the sleeve and into contact with the back face of the nose is electrical contact made between the pressure-distributing plate and the projectile shell or casing.

The impact fuze in accordance with the present invention therefore is extremely rugged so that the projectile can be counted on to explode even when fired with extremely high muzzle velocity. Furthermore the projectile is able to explode even when it strikes a relatively soft object.

SPECIFIC DESCRIPTION

Figure 3:
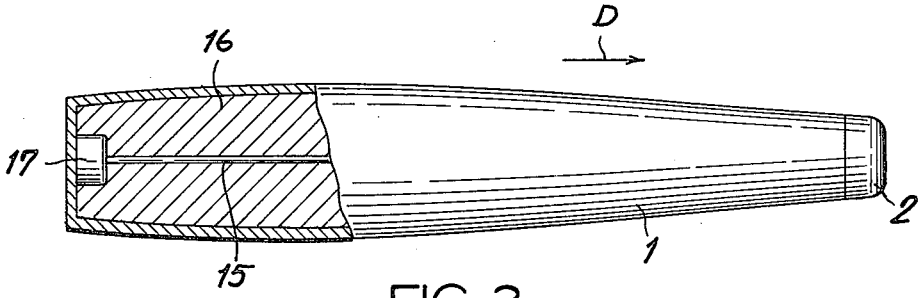
FIG. 3 is a small-scale view, partly broken away, of a projectile, in accordance with the present invention.

The fuze according to the present invention is provided in the nose cap 2 of a shell 1 filled in back of the nose cap 2 with a bursting charge 16 firable by a primer or detonator 17 at the rear end of the shell as shown in FIG. 3. The shell may be fired in a smooth-bore or rifled artillery piece, or may simply be carried on a mortar-type rocket.

Figure 1:
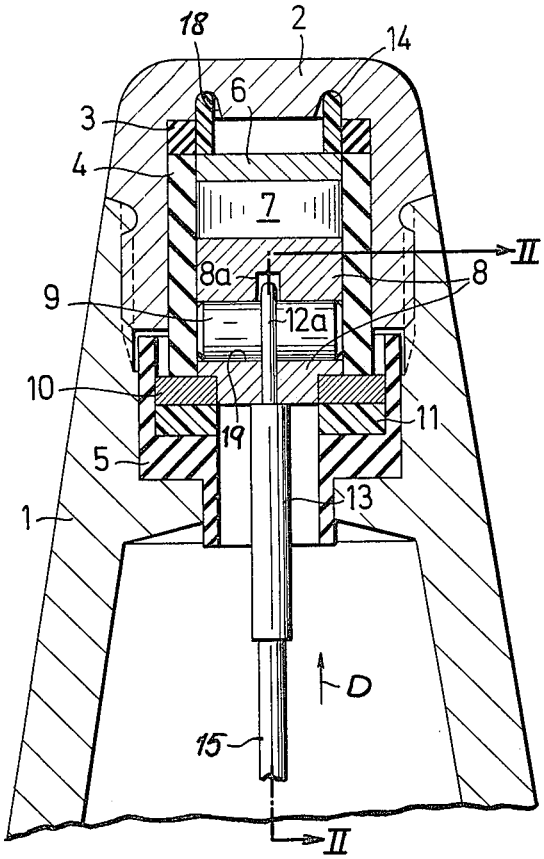
FIG. 1 is a longitudinal section through the nose of a projectile in accordance with this invention.
Figure 2:
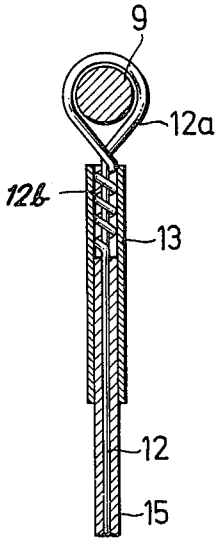
FIG. 2 is a section taken along the line II — II of FIG. 1.

FIGS. 1 and 2 show how the fuze 2 comprises an assembly at its heart formed of a cylindrical piezoelectric crystal 7 sandwiched between a front cylindrical pressure distributing plate 6 and a rear anvil 8. These elements 6 through 8 are slidable in an elastomeric insulating sleeve 4 received within the nose 2 and extending in the direction D of travel of the projectile 1. This sleeve 4 is received between an elastomeric ring 3 at its front end and a metal washer 10 at its rear end, this washer 10 sitting on another washer 11 of synthetic-resin insulating material and on an insert 5 lining the casing 1. The nose 2 is screwed securely down over the above-described parts with an annular sleeve 14 of sponge rubber pressing between a groove 18 formed on the inside face of the nose and the upper face of the plate 6. The ring 14 is sufficiently compressible so that the plate 6 may make electrical contact with the nose 2 when pressed forwardly.

The anvil 8, which is relatively massive compared to the crystal 7 and plate 6, is formed with a cylindrical transverse bore 19 in which is press-fitted a steel pin 9 around which is wrapped one end **12*a* of a spring-steel wire 12 that extends back as shown in FIG. 3 to the detonator or primer 17. The anvil is slotted at 8***a* so as to receive the loop 12*a* and the wire is wound around itself at 12*b* and held in an insulating sleeve 13 as shown in FIG. 2. In addition the wire 12 is provided with insulation 15 in back of the wound portion 12*b*.

The fuze functions as follows:

When the projectile 1 is fired and its nose 2 strikes a hard object this nose 2 deforms. The deformation is transmitted through the plate 6 to the crystal 7, which, when compressed, generates an electrical current that is transmitted back through the anvil and through the wire 12 to the detonator 17. The other path of the electrical circuit is made through the nose 2 and housing 1, the detonator 17 being grounded to this housing also. Even when the hit is at a very flat angle, a so-called graze, the pressure-distributing plate 6 serves to compress the crystal 7 and generates the electricity necessary to explode the detonator 17 and the charge 16.

Figure 4:
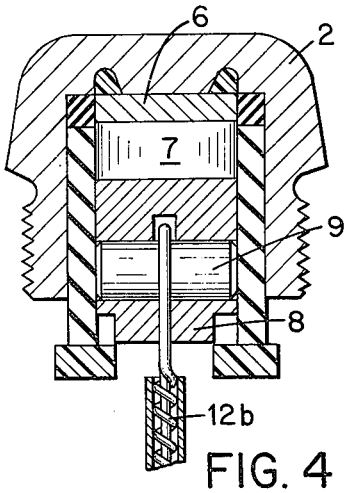
FIG. 4 is a view of a portion of FIG. 1 showing the movement of the assembly of the anvil, piezoelectric crystal and pressure distributing plate against the surface of the nose of the projectile with extension of the wire.

When, however, a relatively soft object such as sand, mud, or the like is struck, the nose 2 is frequently not deformed at all. In this case, however, the anvil 8, crystal 7 and plate 6 all slide forwardly, stretching the coil 12*b* of wire 12, compressing the ring 4 until the plate 6 comes to rest against and makes electrical contact with the inside face of the nose 2 (see FIG. 4). The inertial pressure exerted by the anvil 8 on the crystal 7 serves to generate sufficient electrical energy to operate the detonator 17. It is noted that the other end of the wire 12 may be connected in the same manner to the detonator 17 as it is to the anvil 8.

I claim:

1. In combination with an artillery projectile having a nose and rearwardly of said nose relative to a direction of travel a rear end provided with an electrically activatable detonator, said nose having a contact surface, an impact fuze at the nose of said projectile comprising:

a pressure distributing plate normally spaced from but engageable with said surface, said plate being movable in said direction;

an anvil displaceable in said direction and spaced from said plate;

means resting on said anvil and disposed between said anvil and said plate for producing an electrical current when compressed between said anvil and said plate, said means being movable in said direction;

a pin seated in said anvil and extending transversely to said direction; and a spring-steel wire resiliently retaining said anvil against movement toward said surface, said wire having a front end looped around said pin and a rear end connected to said detonator, said wire being longitudinally extensible in said direction upon impact of said projectile whereby said anvil, said means and said plate are displaced toward said surface, said current passing through said wire from said anvil to said detonator.

2. The combination of structure defined in claim 1 wherein said means is a piezoelectric crystal and said anvil and plate are both electrically conductive.

3. The combination of structure defined in claim 2 wherein said fuze includes a resiliently compressible element in front of said plate, whereby on abrupt stopping of travel of said projectile said anvil, crystal, and plate slide forwardly in said nose and compress said element.

4. The combination defined in claim 3 wherein said element is a block of elastomeric material.

5. The combination of structure defined in claim 3 wherein said fuze includes an insulating sleeve surrounding said anvil, said crystal, and said plate.

6. The combination of structure defined in claim 3 wherein said element is an elastomeric ring compressible so that said plate can make electrical contact with said projectile.

* * * * *